US008499534B2

(12) United States Patent
Gosse et al.

(10) Patent No.: US 8,499,534 B2
(45) Date of Patent: Aug. 6, 2013

(54) METHOD AND SYSTEM FOR LOADING TABLETS INTO CONTAINERS

(75) Inventors: Brian Ernest Gosse, Brampton (CA); Kenneth James Woolley, Georgetown (CA); Martin Vincent Waite, Mississauga (CA)

(73) Assignee: Patheon Inc., Mississauga, ON (CA)

( * ) Notice: Subject to any disclaimer, the term of this patent is extended or adjusted under 35 U.S.C. 154(b) by 325 days.

(21) Appl. No.: 12/821,438

(22) Filed: Jun. 23, 2010

(65) Prior Publication Data

US 2011/0314775 A1 Dec. 29, 2011

(51) Int. Cl.
*B65B 5/10* (2006.01)

(52) U.S. Cl.
USPC ..... 53/475; 53/447; 53/532

(58) Field of Classification Search
USPC ..... 53/447, 475, 532, 540, 541
See application file for complete search history.

(56) References Cited

U.S. PATENT DOCUMENTS

| | | | | |
|---|---|---|---|---|
| 3,159,308 | A | 12/1964 | Passavanti | |
| 4,744,455 | A | 5/1988 | Dragotta et al. | |
| 5,329,749 | A * | 7/1994 | Yamamoto et al. | 53/525 |
| 5,366,112 | A | 11/1994 | Hinterreiter | |
| 6,256,967 | B1 | 7/2001 | Hebron et al. | |
| 6,345,487 | B1 | 2/2002 | Luciano et al. | |
| 6,363,687 | B1 | 4/2002 | Luciano et al. | |
| 6,499,277 | B1 * | 12/2002 | Warner et al. | 53/447 |
| 6,889,869 | B2 | 5/2005 | Hallin | |
| 7,255,247 | B2 | 8/2007 | Aylward | |
| 8,015,777 | B2 * | 9/2011 | Yagyu et al. | 53/447 |
| 2002/0189205 | A1 * | 12/2002 | Hart et al. | 53/447 |
| 2004/0011806 | A1 | 1/2004 | Luciano et al. | |
| 2005/0000192 | A1 | 1/2005 | Aylward | |
| 2008/0105516 | A1 | 5/2008 | Richwine | |

FOREIGN PATENT DOCUMENTS

WO 2008/071233 A1 6/2008

* cited by examiner

*Primary Examiner* — Hemant M Desai
(74) *Attorney, Agent, or Firm* — Smart & Biggar

(57) ABSTRACT

A system for packaging a plurality of tablets is disclosed that includes a container. The container comprises a generally elongated channel having a first end and a second end positioned below the first end. The first end has an aperture for receiving a plurality of tablets in series into the channel. The system also includes a container holding and vibration apparatus operable to hold the container and concurrently apply linear vibration in a direction to the container. A tablet delivery system is provided that is operable to deliver the tablets in series to the container in a direction that is substantially in alignment with the direction of linear vibration of the container. The linear vibration of the container provided is operable to align the tablets in a stacked formation within the channel of said container.

28 Claims, 9 Drawing Sheets

METHOD AND SYSTEM FOR LOADING TABLETS INTO CONTAINERS

FIELD OF THE INVENTION

The present invention relates generally to methods and systems for loading tablets, including micro-tablets, into containers.

BACKGROUND OF THE INVENTION

Tablets are prevalent in various fields including in the pharmaceutical, veterinary and confectionary fields. Tablets can be manufactured in a wide range of sizes. For example, typical disc shaped tablets may have diameters in the range of 5 mm to 20 mm and thicknesses in the range of 3 mm to 10 mm. One particular category of tablets is that of "micro-tablets", which are named as such due to their relatively small dimensions. For example, disc shaped micro-tablets may have diameters in the range of 2 mm to 3 mm and thicknesses in the range of 0.6 mm to 0.9 mm.

Tablets can be made in a wide variety of cross-section shapes such as circular shapes, diamond shapes, arrow-head shapes and hexagonal shapes. Regardless of the cross sectional shape, many tablets are formed in a generally flattened shape with two opposed sides having typically with significantly larger surface areas than the other sides. Typically, those two larger surfaces have opposed sides are oriented generally parallel to each other. A common example is a generally disc shaped tablet. Despite having sides that may be slightly convex, concave or bevelled with for example bisectional lines, many tablets lend themselves to being packaged into a specifically designed and configured container, and being held in a "stacked" formation within the container with the largest side surfaces of the tablets being adjacent to each other (i.e. the tablets are generally lying flat, one on top of another with their largest surface areas generally facing the largest surface area of an adjacent tablet).

Some containers are referred to as cartridges if the container holding a plurality of tablets is intended to be used in conjunction with a dispensing device, such that loaded tablets can be dispensed from the cartridge by the dispensing device. In many such devices, the stacked orientation can help in preventing jamming.

A plurality of tablets may be loaded into a container that has a generally complimentary cross-sectional area sized and shaped to appropriately receive and hold tablets in a stacked configuration. In the aforementioned example, disc shaped tablets may lend themselves well to being packaged in a stacked formation in a container having at least one longitudinally extending channel or tube that is generally cylindrically shaped. Among other things, such a stacked orientation of a plurality of tablets typically minimizes the space occupied by tablets and allows a maximum number of tablets to be loaded into a given container. Stacking of tablets may also assist in ensuring that a specific and predetermined number of tablets are consistently loaded into and held in each container in a series of containers.

In some known types of systems for packaging tablets, loading of the tablets into the actual container takes place by allowing the tablets to free fall under the influence of gravity into and within a container. The container is generally oriented such that the channel is oriented generally vertically and is held stationary during loading. However, such a loading of tablets within the channel is unpredictable due to the inherently random nature of free fall as tablets fall into these containers. It is far from certain that the tablet will come to rest in a flattened stationary orientation within the channel, such that tablets will be stacked in a flat configuration against adjacent tablets in the container. This unpredictability is even more pronounced with smaller lighter tablets, such as micro-tablets which may be subject to a significant degree of turbulence in free fall and may encounter more electrostatic interaction with the container. Thus, it is quite possible that at the end of the free fall into the container, the tablet will not come to rest in the flat orientation required for stacking.

Accordingly, an improved method and system is desirable which can enhance the chances of properly seating tablets in a stacked orientation during the loading of the container.

SUMMARY OF THE INVENTION

According to an aspect of the present invention there is provided a system for stacking a plurality of tablets within a container comprising: (a) a container comprising a generally elongated channel having a first end and a second end, the first end being positioned above the second end and having an aperture for receiving a plurality of tablets in series into the channel, the second end providing at least partial support for a plurality of tablets stacked within the channel; (b) a container holding apparatus for releasably holding the container; (c) a vibration device operable to apply linear vibration to the container while the container is being held by the holding apparatus; and (d) a tablet delivery system operable to deliver the plurality of tablets sequentially to the first end of the channel; wherein the linear vibration of the container provided by the vibration device aligns the sequentially loaded plurality of tablets received into the channel in a stacked formation within the channel.

According to another aspect of the present invention there is provided a system for packaging a plurality of tablets comprising: (a) a container comprising a generally elongated channel having a first end and a second end positioned below the first end, the first end having an aperture for receiving a plurality of tablets in series into the channel; (b) a container holding and vibration apparatus operable to hold the container and concurrently apply linear vibration in a direction to the container; and (c) a tablet delivery system operable to deliver the plurality of tablets in series to the first end of the container in a direction that is substantially in alignment with the direction of linear vibration of the container, wherein the linear vibration of the container provided by the vibration device is operable to align the sequentially loaded plurality of tablets in a stacked formation within the channel of the container.

According to yet another aspect of the present invention there is provided a system for packaging a plurality of tablets comprising: (a) a container comprising a generally elongated channel having a first end and a second end, the first end having an aperture for receiving a plurality of tablets in series into the channel; (b) a container holding and vibration apparatus operable to hold the container and concurrently apply linear vibration in a direction to the container; and (c) a tablet delivery system operable to deliver the plurality of tablets in series in an on-edge orientation to the first end of the container in a direction that is substantially in alignment with the direction of linear vibration of the container, (d) a tablet detection and counting system for detecting each of the plurality of tablets being delivered by the tablet delivery system while each of the plurality of tablets in the on-edge orientation; wherein the linear vibration of the container provided by the vibration device is operable to align the sequentially loaded plurality of tablets in a stacked formation within the channel of the container.

According to a further aspect of the present invention there is provided a method of loading a container having an elongated channel with tablets, the method comprising: (a) loading the channel with a plurality of tablets; (b) applying linear vibration to the channel containing the tablets; wherein the linear vibration of the channel is operable to align the plurality of tablets in a stacked formation within the channel.

According to a still further aspect of the present invention there is provided a system of loading a container having an elongated channel with tablets, the method comprising: (a) a means for loading the channel with a plurality of tablets; (b) a means for applying linear vibration to the channel containing the tablets; wherein the linear vibration of the channel is operable to align the plurality of tablets in a stacked formation within the channel.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate by way of example only, embodiments of the present invention.

DETAILED DESCRIPTION

With reference to FIGS. 1-6, a tablet filling system 10 is illustrated that is operable to fill a container 146 with a plurality of tablets 32. Tablets 32 may be micro-tablets and may be one or more of many types of tablet used in a large number of fields, including in the pharmaceutical, veterinary or confectionary fields. Tablets 32 to be loaded into a particular container may each be of the same shape, size and may also be made from the same materials. Tablets can be made in a wide variety of cross-section shapes such as circular shapes, diamond shapes, arrow-head shapes and hexagonal shapes. The tablets may be formed in a generally flattened shape with two opposed sides having typically with significantly larger surface areas than the other sides. Typically, those two larger surfaces may have opposed sides are oriented generally parallel to each other, such as a generally disc shaped tablet. Even though the sides that may be slightly convex, concave or bevelled with for example bisectional lines, the tablets may lend themselves to being packaged into container 146, and being held in a "stacked" formation within the channel of the container with the largest side surfaces of the tablets being adjacent to each other (i.e. the tablets are generally lying flat, one on top of another with their largest surface areas generally facing the largest surface area of an adjacent tablet).

Figure 4:
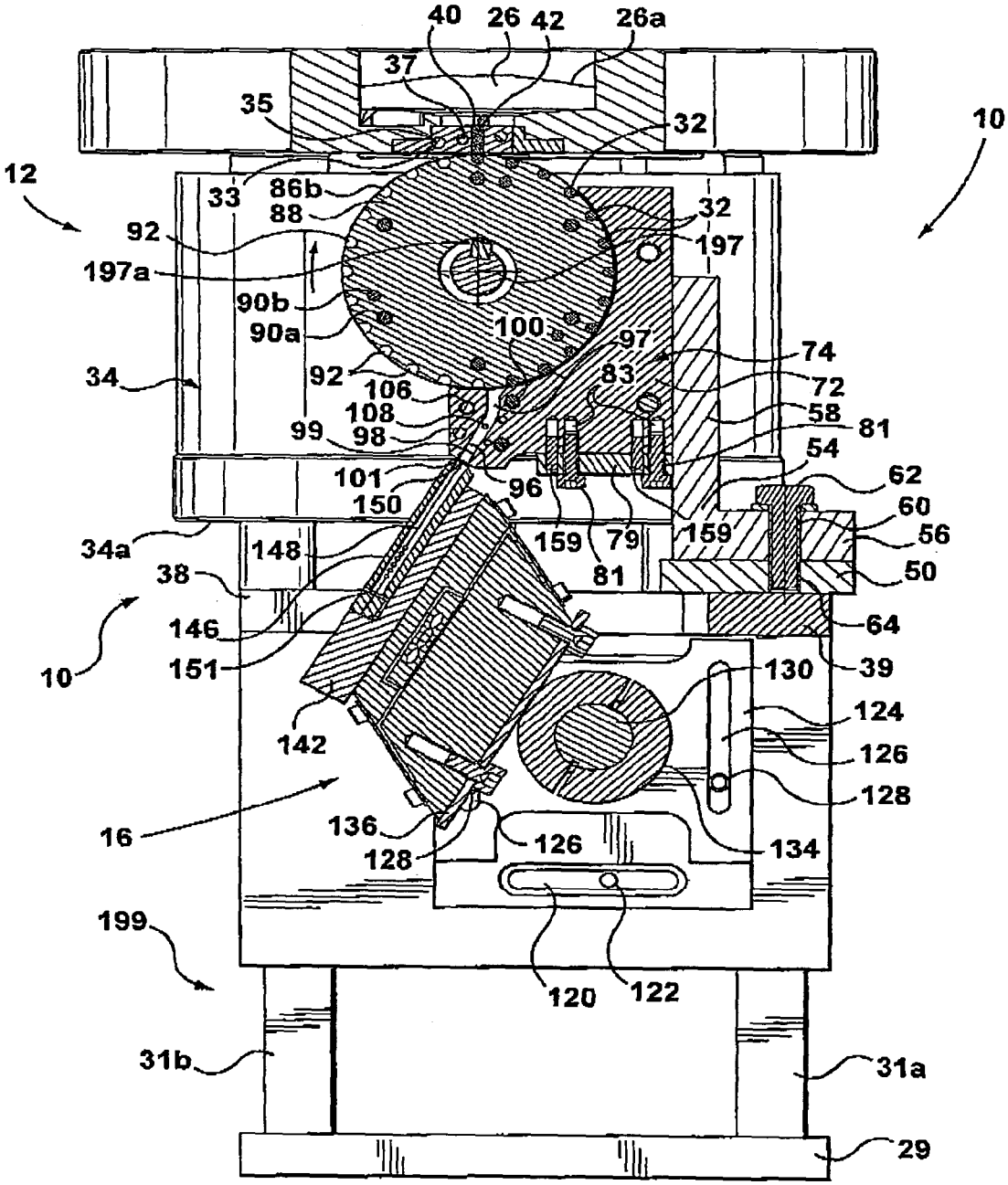
FIG. 4 is a cross sectional schematic view of the system of FIG. 1, at A-A of FIG. 3.

With particular reference to FIG. 4, container 146 may be configured in the form of a cartridge that is suitable for use with a tablet dispensing device (not shown). The specific forms and design of containers that can be loaded using system 10 are numerous, but do require a channel having an opening at the top end of the channel 148 to receive a plurality of tablets 32.

Container 146 may be formed in a generally flattened cuboid shape and may have at least one tube or channel 148 formed in a generally cylindrical shape extending longitudinally for at least a portion of the length of the container between an opening 150 towards a base 151. Container 146 and channel 148 may have a wide range of dimensions, depending upon the number, shape and size of tablets to be held in the container, and may have a generally circular cross-section that is large enough to accommodate the tablets in a stacked orientation in the channel.

Figure 1:
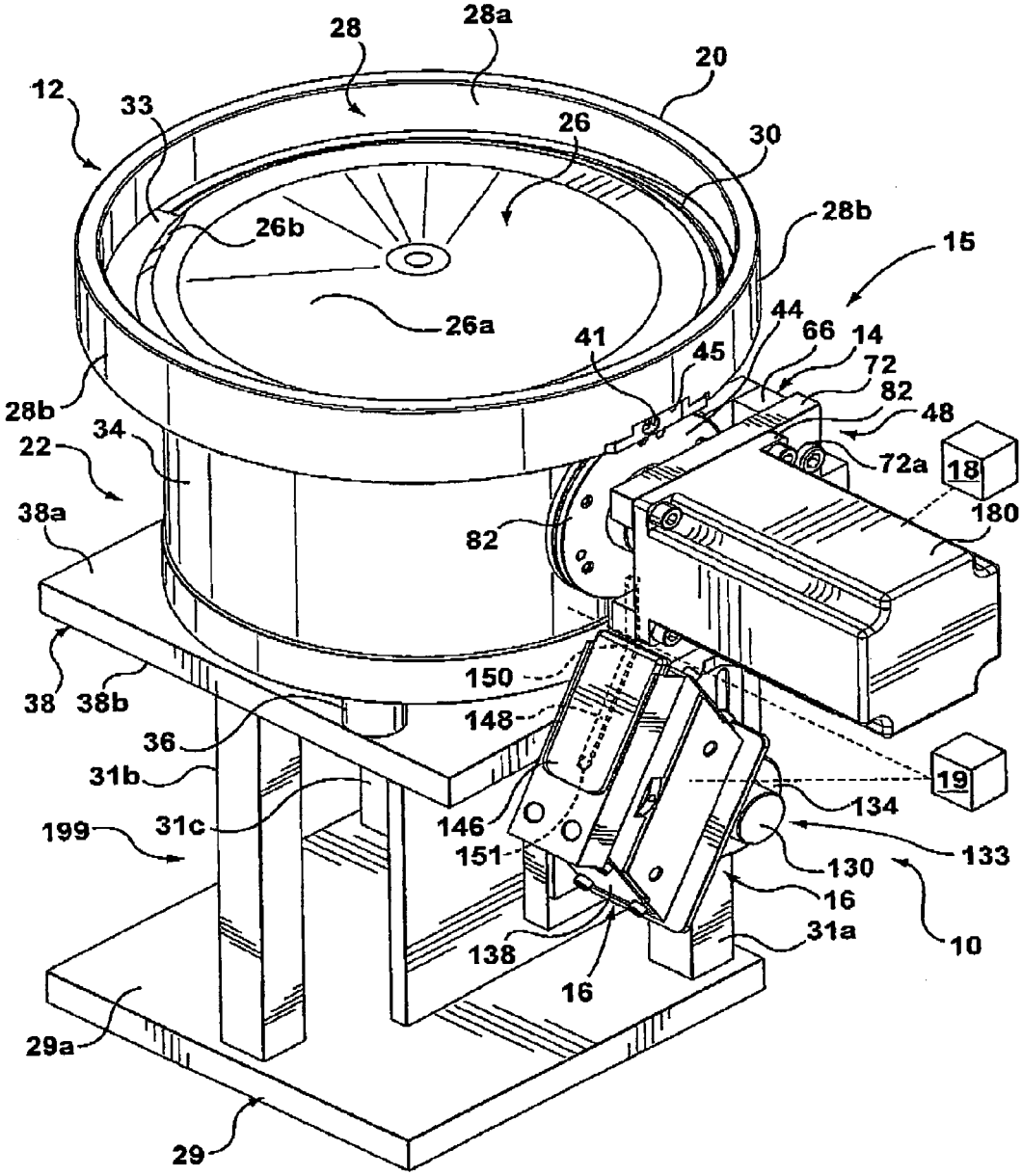
FIG. 1 is a top, left front perspective view of a tablet filling system in accordance with a first example embodiment of the present invention.
Figure 2:
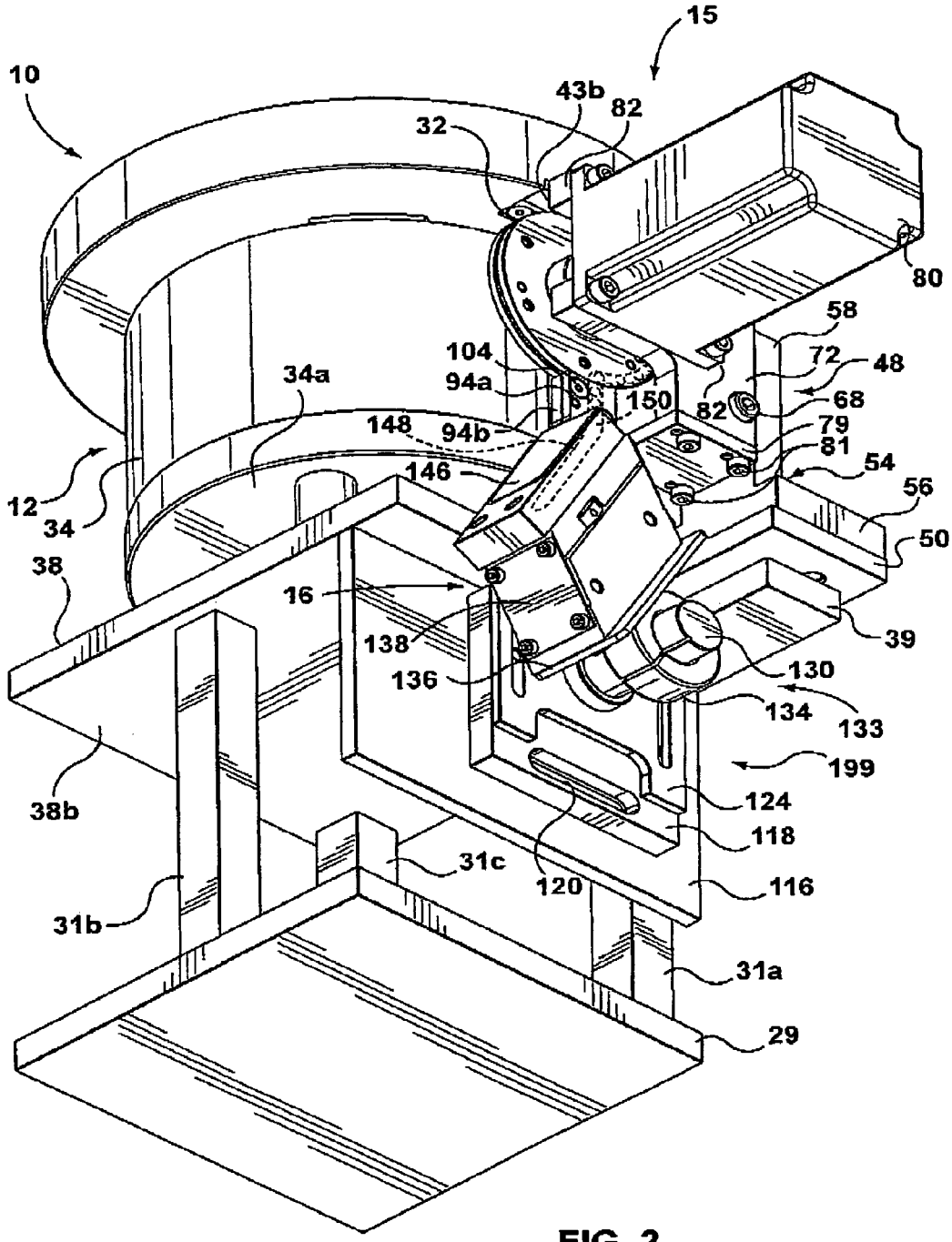
FIG. 2 is a bottom, left front perspective view of the system of FIG. 1.

With reference to FIGS. 1 and 2, system 10 may consist of several components including a support frame generally designated 199, a sorting bowl apparatus 12, a capture wheel apparatus 14 and a cartridge holding and vibration apparatus 16. Sorting bowl apparatus 12 and capture wheel apparatus 14 comprise a tablet delivery system 15 that delivers tablets to a container (e.g. cartridge) held in cartridge holding and vibration apparatus 16.

Tablet filling system 10 may also include a programmable logic controller ("PLC") 18 (only shown schematically in FIG. 1) to control the operation of one or more of the components of system 10. PLC 18 may be, for example, a model CPIL M40DT-D made by Omron. PLC 18 may be configured to control the rotation of the counting/capture wheel of apparatus 14, the starting/stopping of this capture wheel and the counting of the tablets 32 as they fall into the cartridge 146.

System 10 may also include a vibration controller device 19 (shown only schematically in FIG. 1) that may control the vibrators that may be part of vibrating bowl apparatus 14 and of the cartridge holding and vibration apparatus 16. The vibration of bowl 20 and the vibration of cartridge 146 by respective vibrators may be both independently controlled through use for example, of a single RNA vibration control unit, RNA ESK 2001 UL. This RNA controller can vary the intensity and/or frequency of the vibration provided by each of the vibrators.

Support frame 199 may provide support for at least some of the components of system 10. Support frame 199 may include a horizontal, transversely and longitudinally extending upper support plate 38 and lower base plate 29 that are interconnected to each other by support legs 31*a-c*. Support plate 38 may thus be supported by legs 31, with legs 31*a-c* being mounted to a lower horizontal surface 38*b* of support plate 38 of frame 199 by, for example, bolts/screws (not shown). Legs 31*a-c* may also be interconnected to base plate 29 of frame 199, with the bottom surfaces of legs 31 being mounted to upper surface 29*a* of base 29 by, for example, bolts/screws (not shown). Support frame 199 may also include a vertically and longitudinally extending vibration support plate 116. Support plate 116 may be interconnected and joined to lower horizontal surface 38*b* of lower support plate 38 by way of, for example, welding, bolts/screws or another known connection mechanism. Support plate 116 may provide support for cartridge holding and vibration apparatus 16.

Sorting bowl apparatus 12 may be mounted on top of upper support plate 38 of frame 199 and may consist of several components including a bowl 20, a bowl support frame 22, and a vibration unit (not shown) that may be housed inside an oriented cylindrical housing unit 34 that forms part of bowl support frame 22. Numerous different types of known sorting bowl units may be used in system 10. Sorting bowl 20 may, for example, be a cylindrical, stepped or conical sorting bowl.

Figure 3:
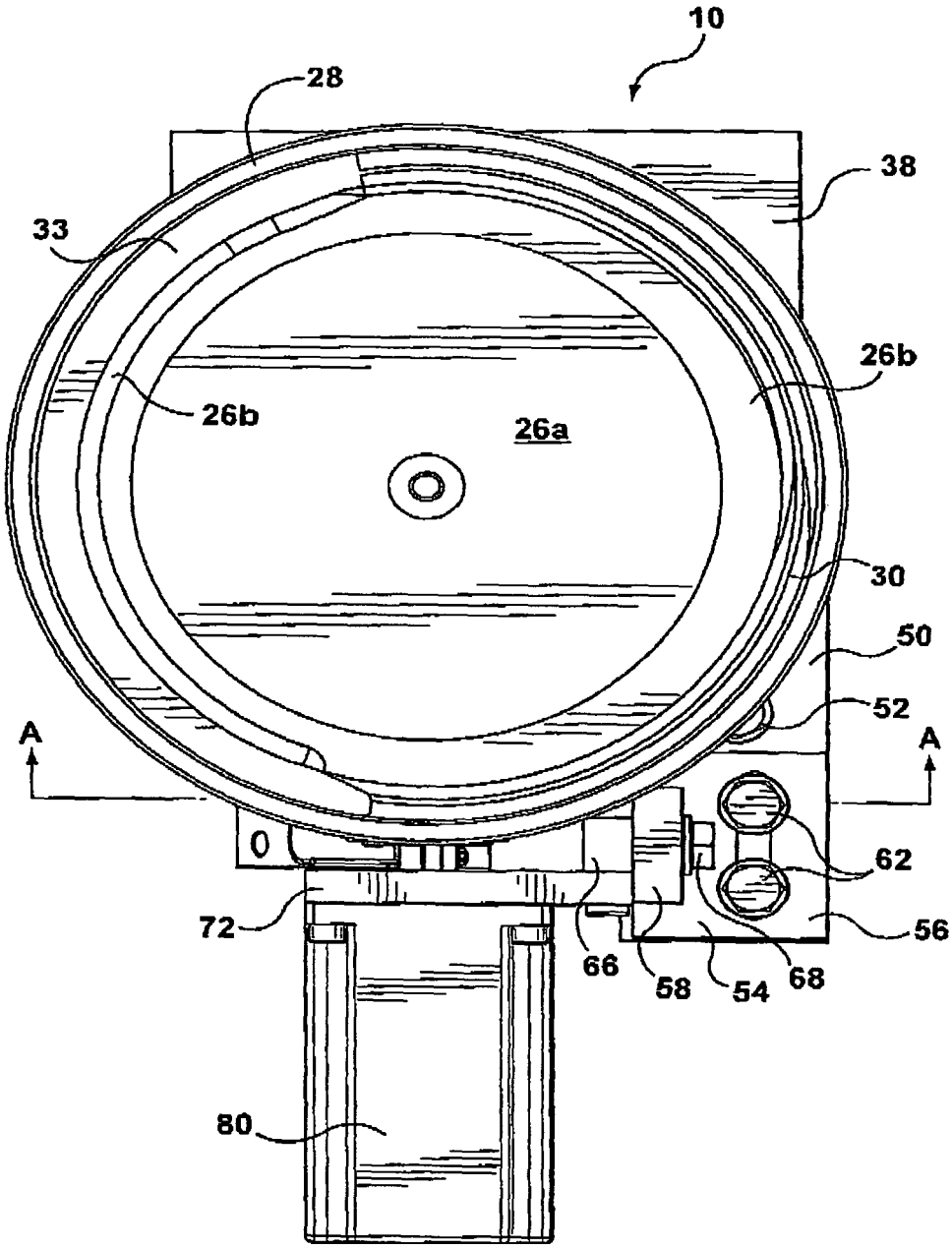
FIG. 3 is a top plan schematic view of the system of FIG. 1.

With particular reference to FIGS. 1, 3 and 4, bowl 20 may have a base 26 with upwardly directed surfaces 26*a* and 26*b*. Bowl 20 may also have a generally vertically oriented, circumferentially extending side wall 28 having an inwardly directly circular surface 28*a* that generally surrounds base 26. Sorting bowl 20 may be sized and configured to be appropriate for receiving therein a plurality of tablets 32.

With reference to FIGS. 1 and 3, base 26 may have a generally circular edged, upwardly directed raised surface area 26*a* surrounded by an outer downwardly sloped edge surface 26*b*. Extending between the outer edge of surface 26*b* and inner side wall surface 28*a* may be located a trough base 33 that extends around the periphery of surface 26*b* proximate inside wall surface 28*a* of wall 28. Outer trough base 33 may contain a generally annular channel 30 located and extending around a portion of the periphery. Channel 30 may have a generally rectangular cross section and thus may be configured for receiving micro-tablets 32 in an on-edge, longitudinally oriented configuration. Trough base 33 including the portion containing annular channel 30, may have a generally clockwise downward gradient. Thus tablets that move into trough 33 and into channel 30 may tend to move in a clockwise direction along trough base 33 into channel 30 and towards an exit aperture 40. Bowl 20 may be made from one or more of a wide variety of materials such as aluminium which is anodized. It may be constructed as a solid, unitary piece such that base portions 26*a* and 26*b* do not rotate.

Movement of the tablets 32 may be caused solely by the vibration transferred from the vibrator unit mounted below the bowl inside housing 34. The channel 30 may be machined into the upper surface area of the bowl and may be sized/angled to force the tablets from a flat position to an "on edge" position as they rotate around the bowl into and then clockwise within channel 30. However, in other tablet loading systems, other types of apparatus may be utilized that can deliver tablets sequentially in an on-edge orientation to an aperture in the bowl for delivery in an on-edge orientation to capture wheel 44 of capture wheel apparatus 14.

With particular reference to FIG. 4, channel 30 of bowl 20 may terminate at an aperture 40 that is configured to allow a single tablet 32 at a time, while maintaining its generally vertical on-edge orientation, to exit sorting bowl 20. Aperture 40 may thus lead directly and be positioned to provide an upper opening to a vertically oriented loading chute 42. Loading chute 42 may be of appropriate shape and dimensions to maintain micro-tablets 32 singly in a series in a vertical on-edge orientation and provide a conduit for the tablets 32 to move singly in series from sorting bowl 12 to capture wheel 44 of capture wheel apparatus 14. As may be discerned from FIG. 4, loading chute 42 may be configured to hold within it, and maintain for a period of time, a plurality of tablets 32 in a stacked vertical, on-edge orientation.

With reference to FIGS. 1 and 2, bowl 20 may be supported by a bowl support frame 22, which may include a vertically oriented cylindrical housing unit 34 and support legs 36 that are mounted on upper surface 38*a* of horizontal plate 38 of support frame 199. As previously stated, housing unit 22 may enclose the vibration unit (not shown) which in turn may be in physical contact with base 26 of bowl 20 so as to provide vibration to base 26 of bowl 20. The vibration/drive unit may for example consist of a RNA Model SRC-N 160-2R vibrator drive sold by RNA Automated Systems Inc. Sorting bowl apparatus 12 may be communication with controller device 19 such that the vibration of bowl apparatus 12 may be controlled.

Lower horizontal surface 34*a* of housing unit 34 may be interconnected to and supported by several longitudinally extending vertical support legs 36, with support legs 36 being mounted to lower horizontal surface 34*a* of housing unit 34 by, for, example blots/screws (not shown). Support legs 36 may also be interconnected and supported on the upper surface 38*a* of horizontally oriented support plate 38 of support frame 199 by for example screws/bolts (not shown).

With particular reference to FIGS. 2, 3, 4, 5 and 5*a*, loading chute 42 may be formed from opposing inner and outer L-shaped plates 43*a*, 43*b*. Plate 43*a* and plate 43*b* may be positioned in a recess 45 in outer wall 28*b* of bowl 20. Plate 43*a*, plate 43*b* and recess 45 may be formed with co-operating portions such that interconnection and joining of plate 43*a* to plate 43*b* within recess 45, with upstanding leg of plate 43*a* being in abutment with upstanding leg of plate 43*b*, will form loading chute 42. For example, with reference to FIGS. 5*a*, plate 43*a*, may have a screw hole 41*a* which may enable screw 141*a* to pass horizontally through outer plate 43*a* into a threaded hole in the inside surface of recess 45.

Similarly, plate 43*b*, may have screw hole 41*b* which may enable screw 141*b* to pass horizontally through plate 43*b* horizontally into a threaded hole in the inside surface of recess 45. Plate 43*b* may have a vertically oriented slot (see FIG. 5*a*) formed in the outer facing surface to provide chute 42. Inner plates 43*a* and 43*b* may be interconnected and joined to the lower surface of bottom surface 26 of bowl 20. When positioned in recess 45, inner plates 43*a* and 43*b* are held together in face to face relation to each other and chute 42 is formed by the vertical slot in plate 43*b*. Chute 42 may have an opening 42*a* positioned and configured to receive tablets 32 singly in an on-edge orientation as they exit bow) 20. Tablets then can pass through chute 42 to exit opening 42*b* which can be aligned in a position to deliver tablets to capture wheel 44 of capture wheel apparatus 14.

The next component of system 10 to be described in detail is capture wheel apparatus 14. Capture wheel apparatus 14 may have several components including a capture wheel 44 and a capture wheel support frame 48.

Capture wheel support frame 48 will be described in detail with particular reference to FIGS. 2, 3, 4, 5, 6 and 7. Capture wheel support frame 48 is supported in part on and by a horizontal, generally transversely extending, extension portion 39 from plate 38 of support frame 199. Capture wheel support frame 48 may include a horizontally oriented and generally transversely extending upper support plate 50. Support plate 50 may be positioned and connected to the upper horizontal surface of plate 38 including the upper surface of extension portion 39 of support plate 38. A portion of upper support plate 50 may overhang extension portion 39 as is illustrated in FIG. 2.

Figure 7:
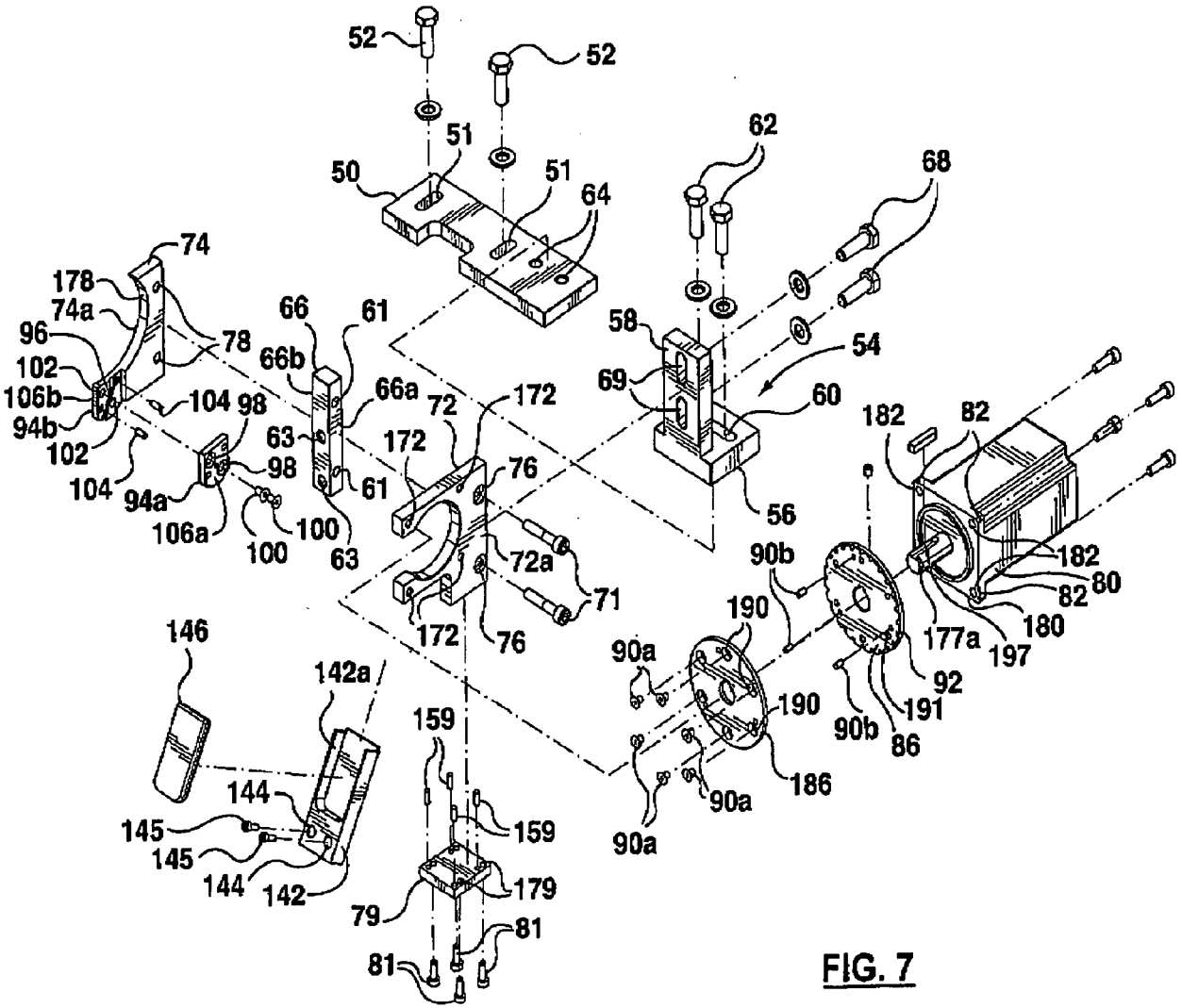
FIG. 7 is an exploded view of some of the components of the system of FIG. 1.

For example, with reference to FIGS. 4 and 7, upper support plate 50 may have screw holes 51 which may enable screws 52 to pass downwards through plate 50 into threaded holes (not shown) in support frame 38. Support frame 48 may also include a generally L-shaped support bracket member 54 which may have a horizontal, generally transversely and longitudinally extending base portion 56 and a vertically and transversely extending leg portion 58. Horizontal base portion 56 of L-shaped support member 54 may be positioned and connected to the upper horizontal surface of upper support plate 50. For example, with reference to FIGS. 4 and 7, horizontal base portion 56 of L-shaped support member 54, may have hole(s) or a slot 60 which may enable screws 62 to pass downwards through base portion 56 into threaded holes 64 in upper support plate 50.

Support frame 48 may also include a vertically extending generally cuboid shaped, anchor and spacer block 66 positioned and connected with bolts or screws 68 that pass through openings at inner vertically oriented surface of leg portion 58 of L-shaped support member 54. For example, with reference to FIGS. 5, 6 and 7, leg portion 58 of L-shaped support member 54 may have screw holes 69 which may enable screws 68 to pass horizontally through leg portion 58 into threaded holes 63 in anchor block 66. Support frame 48 may also include a vertically and longitudinally extending forked plate member 72 that is positioned adjacent and mounted to the inner surface 66*a* of block 66. On a transversely opposite side of anchor block 66 is a vertically and longitudinally extending shoe 74. Forked plate 72 and shoe 74 may be positioned and connected to transversely 69 opposite vertical side surfaces 66*a*, 66*b* respectively of block 66 and may be contiguous with inner vertical surface of leg portion 58 of L-shaped support member. For example, with reference to FIGS. 4, 5 and 7, forked plate 72 and anchor block 66, may have screw holes 76 and 61 respectively which may enable screws 71 to pass horizontally through forked plate 72 and anchor block 66 into threaded holes 78 in shoe 74.

Support frame 48 may also include a horizontal, transversely and longitudinally extending connector plate 79 which may be interconnected and joined to the lower horizontal surfaces of forked plate 72 and shoe 74. Thus, part of the upper surface of connector plate 79 can be held in abutment with the downward facing surface of block 66. With reference to FIGS. 2, 4 and 7 connector plate 79, may have screw holes 179 which may enable screws 81 to pass upwardly through connector plate 79 into threaded holes 83 in shoe 74 and threaded holes (not shown) in forked plate 72. Additionally dowel pins 159 may be received in openings in plate 79 and in the lower surfaces of forked plate 72 and shoe 74. Thus, capture wheel support frame 78 may, with forked plate 72, provide support for a servo drive motor 80. Additionally, capture wheel support frame 78 in conjunction with shoe 74 may, during rotation of capture wheel 44 hold tablets 32 in slots 92 (see FIGS. 4 and 7).

Capture wheel 44 will now be described in detail with particular reference to FIGS. 4, 6 and 7. Capture wheel 44 may be mounted on shaft 197 using a key 197*a* that is received in a slot 197*b* of shaft 197. Wheel 44 may be driven in a clockwise direction with intermittent movement, by the drive shaft 197 extending from servo drive motor 80. The operation of servo drive motor 80 may be controlled by PLC 18. The angular position of capture wheel 44 may be determined by a resolver (not shown) that provides an electronic signal to PLC 18 to cause PLC 18 to drive motor 80 to rotate capture wheel 44 so that the precise rotational positions of the wheel can be provided during operation.

Servo drive motor 80 may have an outer housing 180 that has flanged portions 82. Flange portions 82 may be used to mount motor 80 to outer surface 72*a* of forked plate 72. For example, with reference to FIGS. 6 and 7, flanged portions 82 of drive motor 80 may have screw holes 182 which may enable screws 84 to pass transversely through flanged portions 82 and into threaded holes 172 in outer surface 72*a* of forked plate 72. Motor 80 may be in communication with PLC 18 such that operation of motor 80 may be controlled by PLC 18.

Capture wheel 44 may be constructed in numerous different ways to provide a plurality of slots/pockets 92 that are positioned at a fixed radial distance and that are angularly spaced about, a central axis of rotation X (FIG. 4). For example, capture wheel 44 may be constructed by interconnected outer and inner discs 86, 186. Discs 86, 186 may have similar radii and be vertically oriented and extend generally longitudinally to form a composite disc structure of generally uniform outer radius. For example, with reference to FIGS. 4, 6 and 7 inner disc 186 may have screw holes 190 which may enable screws 90*a* to pass transversely through inner disc 186 into threaded holes 191 in outer disc 86. Also, inner disc 186 and outer disc 86 may have appropriately positioned dowel holes which may enable dowel pins 90*b* that are received therein, to hold inner disc 86 and outer disc 186 in stationary relative rotational positions to each other. The arrangement of dowel holes can ensure that inner disc 186 and outer disc 86 can only be assembled in one rotational orientation relative to each other.

Outer disc 86 may be inscribed with multiple slots/pockets 92 angularly spaced from each other, for example, by a constant angle of 15°. Slots 92 can be configured to be capable of receiving and holding a micro-tablet 32 in an on-edge orientation during rotation of capture wheel 44. The sides of slots 92 may be formed by inner surface portions of outer disc 86*a* and inner disc 86*b*. Alternate configurations/constructions are possible for forming capture wheel 44, such that a plurality of open slots like slots 92 may be formed at a constant radius, and spaced around the periphery of a generally circular disc.

This aforementioned construction of capture wheel apparatus 14 provides for relatively easy assembly and disassembly that, for example, slots may be readily cleaned or wheels interchanged so that the system may be easily reconfigured to load different size and/or shaped tablets. Additionally, it should be noted that the width of slot 92 may be readily modified by providing for a shim disc having a configuration like inner disc 86, that may be interposed between outer disc 186 and inner disc 86.

It has been found to be of benefit if the material from which inner disc 186 and outer disc 86 are formed do not have an affinity that attracts the tablets 32 (i.e. the material can be chosen so that tablets 32 tend not to stick in slots 92 and so can be readily discharged from slots 92). Polished aluminium has been found to be one such suitable material for inner disc 186 and outer disc 86.

Shoe 74 may have a complimentary generally inwardly facing arcuate surface 74*a* (FIG. 7) of slightly larger radius than capture wheel 44 and be positioned to maintain micro-tablets 32 in slots 92 dining rotation of capture wheel 44 as it rotates with intermittent movement from a generally 12 o'clock or zero degrees position, through to an approximately 6 o'clock or 180 degree position. Shoe 74 may be configured such that it blocks the openings to slots 92 between approximately 15-30 degrees to about 180 degrees, to counteract the forces resulting from rotation and gravity that tend to try to expel each tablet 32 from its respective slot 92.

With reference to FIGS. 4 and 7, shoe 74 may be formed with a main body portion 178 and a lower face plate portion 94*b* with a detachable face plate portion 94*a*. Plate portion 94*a* can be positioned and attached in face-to-face relationship with plate portion 94*b*. Face plate 94*a* may be releasably connected to face plate portion 94*b*. For example, with reference to FIG. 7, face plate 94*a* may have screw holes 98 which may enable screws 100 to pass transversely through face plate 94*a* into threaded holes 102 in face plate 94*b*. Additionally face plate 94*a* and face plate portion 94*b* may have holes 106*a*, 106*b*, at their inner facing surfaces which enable dowel pins 104 to be received into holes 106*a* of face plate 94*a* and holes 106*b* in face plate 94*b*. The corresponding non-removable main body portion 178 of shoe 74 may be formed with a vertically oriented channel that constitutes a feed chute 96 of appropriate configuration to maintain micro-tablet 32 in an on-edge orientation as each tablet 32 in sequence leaves its respective pocket 92 in capture wheel 44 and travels downwards through feed chute 96 towards cartridge 146. As shown in FIG. 4, feed chute 96 may have an upper vertically oriented portion 97 and a lower non-vertical oriented portion 99 that may be oriented at an angle of, for example, 30° from the vertical. Non-vertical portion 99 may be oriented such that it is in alignment with a channel 148 of cartridge 146 when the cartridge is held in cartridge holding and vibration apparatus 16 such that tablets 32 discharged from feed chute portion 99 will move in such a direction and path that they will be received into channel 148 of cartridge 146.

With reference again to FIG. 4, feed chute 96 may have associated with it, a micro-sensor device 108 capable of detecting passing micro-tablets 32. Micro-sensor 108 may have an optical sensing device. Micro-sensor device 108 may provide an electronic sensing eye (not shown) with an electronic beam that extends within and across the channel within feed chute 96. The beam may be oriented generally horizontally. Micro-sensor 108 can be selected to be of sufficiently high-speed and sensitivity to detect when tablets 32 successively pass down through feed chute 96. Detection of a tablet passing through chute 96 may be assisted by the configuration of feed chute 96 which presents micro-tablet 32 to micro-sensor 108 in on-edge orientation thereby presenting the largest face of micro-tablet 32 to micro-sensor 108 for detection. Micro-sensor 108 may be a model FU53TZ optical fiber sensor and an amplifier model VS-V33, both made by Keyence Corporation.

When a tablet 32 passes the electronic beam, it may be broken causing a signal to be sent by micro-sensor 108 to PLC 18. Micro-sensor 108 may obtain an optical signal from the sensing eye which is then converted to a digital signal that may also be amplified. The sensor device 108 will be in electronic communication with PLC 18 such that the digital signal generated by sensor device 108 can be sent to PLC 18. PLC 18 may also be operable to function as a counting device to keep count of the number of tablets passing through feed chute 96 and thus will track how many tablets have been loaded into a given cartridge 146 held in cartridge holding and vibration apparatus 16.

Figure 5:
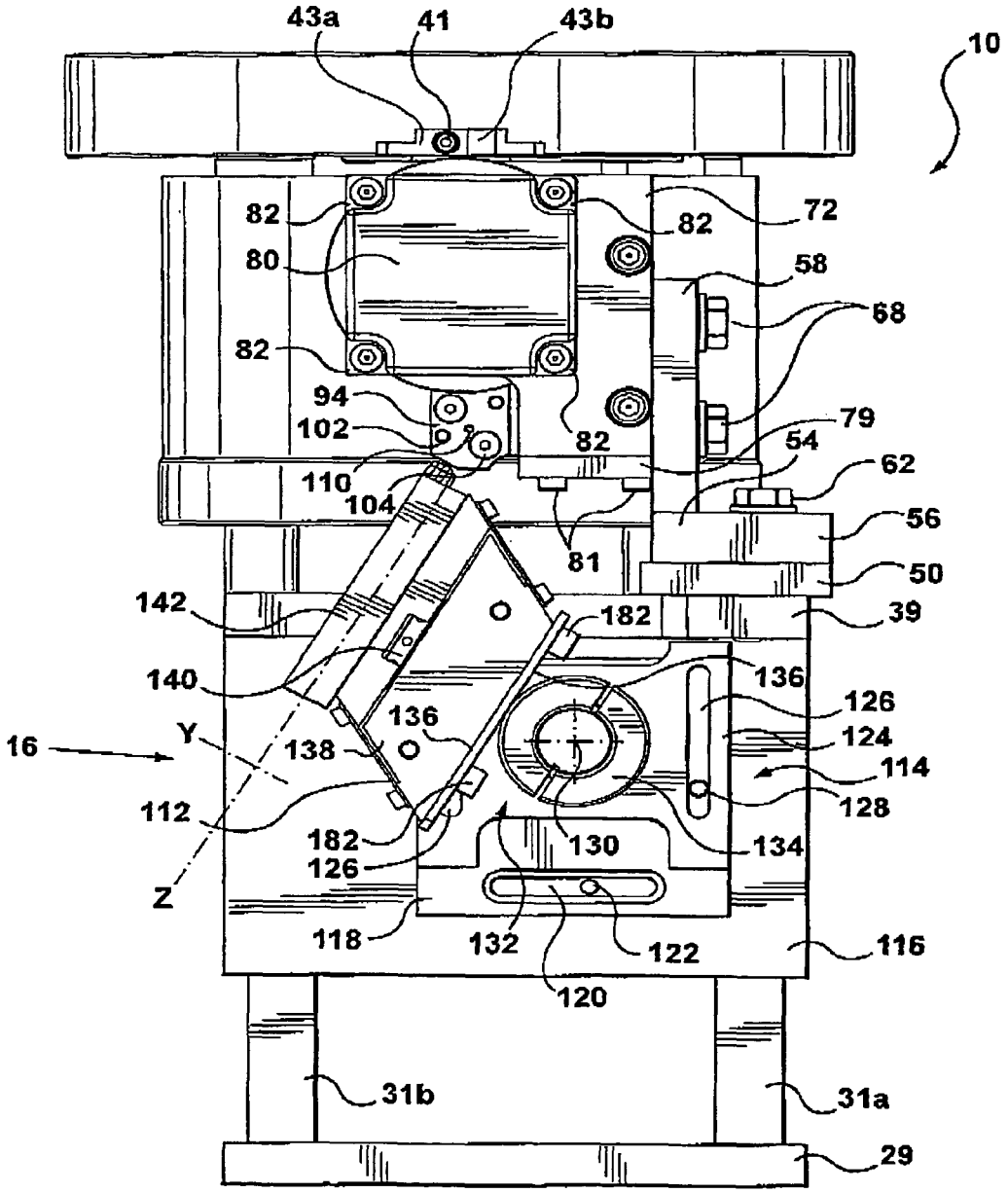
FIG. 5 is front elevation view of the system of FIG. 1.

The next component of system 10 to be described in detail is cartridge holding and vibration apparatus 16. Cartridge holding and vibration apparatus 16 may consist of several components including a cartridge holder 112 and cartridge support frame 114. Support frame 114 will now be described in detail with particular reference to FIGS. 2, 5 and 6. Cartridge support frame 114 may include an inner support plate 118 joined to downwardly depending support plate 116 of frame 199. Support plate 118 may also be joined to an outer support plate 124. Inner support plate 118 may be a longitudinally and vertically extending movable plate mounted to the vertically and longitudinally extending outer surface of support plate 116. Support plate 118 may be configured to be capable of longitudinal movement relative to support plate 116 of frame 199. With particular reference to FIG. 5, plate 118 may have a longitudinally elongated aperture 120 which may enable a screw 122 that is attached to and extends outwardly from plate 116 to pass transversely through plate 118 into a threaded hole (not shown) in plate 116. The movement of screw 122 in longitudinally elongated aperture 120 allows for the adjustment of plate 118 in the longitudinal direction relative to plate 116.

Vertically and longitudinally oriented and extending plate 124 may be mounted at the vertically and longitudinally extending outer surface 118*a* of plate 118. Plate 124 may be mounted to plate 118 for vertical movement relative to plate 118. For example, with reference to FIG. 5, plate 124 may have a pair of spaced, vertically oriented and elongated apertures 126. Apertures 126 may enable a corresponding screw 128 to pass transversely through plate 124 into threaded holes (not shown) in plate 118. Vertically elongated apertures 126 allow for the movement of plate 124 in a vertical direction relative to plate 118.

Extending horizontally and transversely outwards from plate 124 may be a shaft 130. Shaft 130 may have mounted around it a cartridge positioning device 133. Cartridge positioning device 133 may include an O-clamp device 134 that may be releasable secured to and rotated about shaft 130. It will be appreciated that O-clamp may be rotated relative to shaft 130 and may be positioned securely at varying axial positions on shaft 130. As described below, cartridge holding device 112 is secured to O-clamp 134. It will the therefore appreciated that by movement of plate 118 relative to plate 116, and plate 124 relative to plate 118, provides for two degrees of freedom of movement of cartridge holding device 112. The rotational and axial movement of clamp device 134 on shaft 130 extends the type of movement and positioning of cartridge holding device 112 that is possible.

By way of further explanation, by translational movement of plates 118 and 124, and rotational and axial movement of O-clamp device 134, cartridge holding device 112 can be appropriately positioned and angled for loading of container 146 with tablets 32. For example, cartridge holding device may be positioned such that container 146 is oriented longitudinally at an angle of 30° from vertical.

Cartridge holding device 112 will now be described in detail and includes a transversely oriented plate portion 136. The angular position of plate 136 may be adjusted by the positioning of O-clamp 134 on shaft 130, as plate 136 is affixed to a location on the outer surface of O-clamp 134, for example by welding or in a similar known manner.

A vibration device 138 may be supported by and connected to plate portion 136. Vibration device 138 may provide for a vibration of a cartridge 146 held in holding device 112. To be able to achieve the desired stacking of tablets 32 in cartridge 146, the vibration provided by device 138 includes linear vibration of the cartridge (i.e. cyclical forward and backwards movement in the Z direction (see FIG. 5). For example, vibration device 138 may be a linear vibrator model SLV 30 (identification number LTN30/8100280) that is distributed by RNA Automation Inc. and may linearly vibrate in direction Z at a frequency over a range of 3000-3600 oscillations per minute with the amplitude being in the range of 0 to 0.356 mm [i.e. minimum to maximum amplitude in each cycle]. It will be appreciated that the frequency and amplitude employed for the linear vibration that is required to achieve the desired stacking may vary depending upon several variables including the configuration of the particular tablets to be stacked and the angle of channel 148 of cartridge 146. The vibration provided by device 138 may be controlled by controller 19, as referenced above. It may also be possible to employ rotational/torsional vibration to cartridge 146 or vibration movement in other than the Z direction, so long as it does not interfere with the linear vibration in direction Z needed to achieve the stacking of tablets 32 in a flat face to face relationship and it does not interfere with delivery of tablets 32 in such a manner that tablets will be received into opening 150 of cartridge 148.

With reference again to FIG. 5, plate portion 136 of cartridge holding apparatus 112, may have screw holes (not shown) which may enable screws 182 to pass upwards through plate portion 136 and into threaded holes (not shown) in vibration device 138. A jig or cartridge holder 142 may be supported by and be positioned above vibration device 138.

Figure 6:
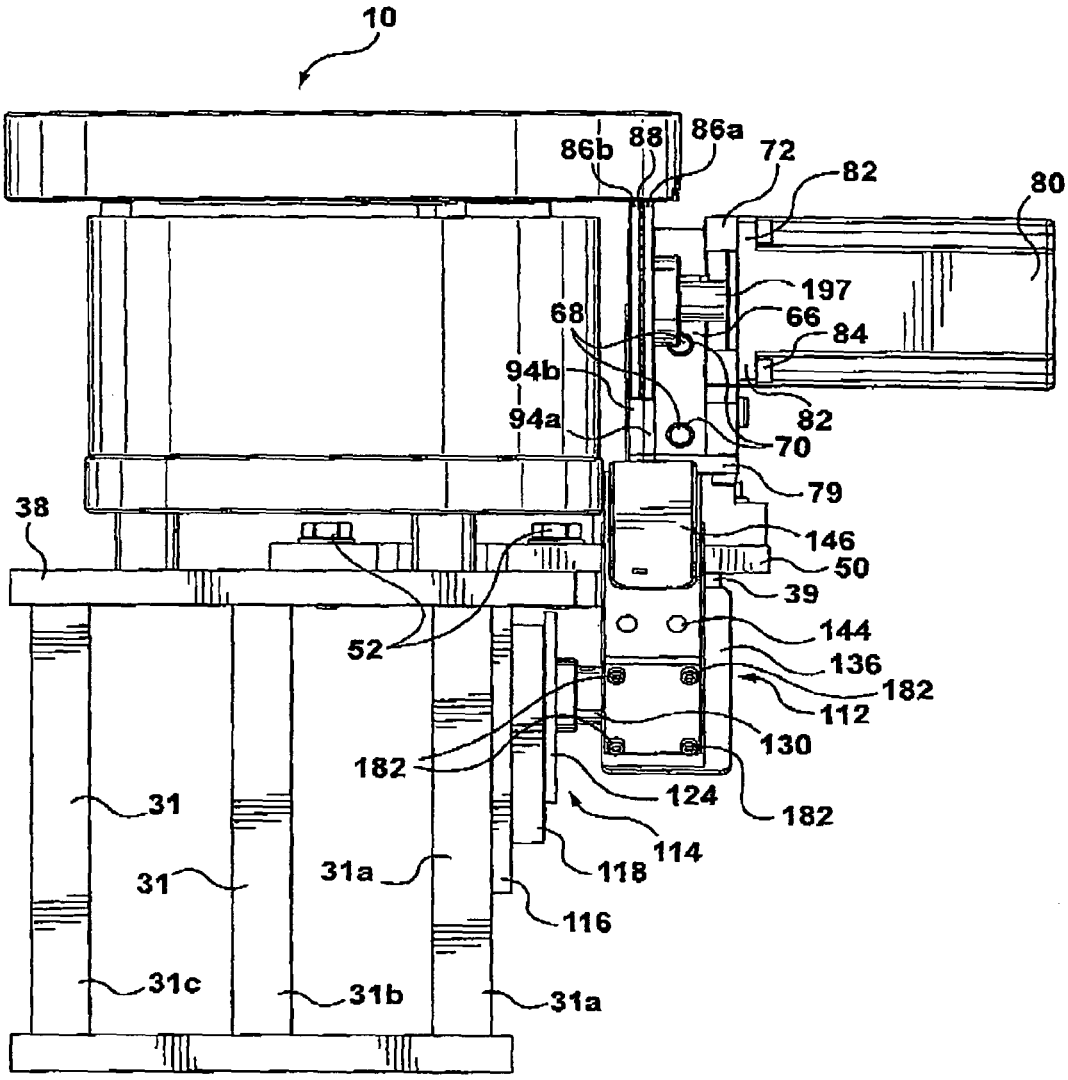
FIG. 6 is a left side elevation view of the system of FIG. 1.

For example, with reference to FIGS. 6 and 7, jig 142, may have screw holes 145 which may enable screws to pass generally downwardly through jig 142 and into threaded holes 144 in vibration device 138.

Jig 142 may be inscribed so as to form a template of generally complimentary shape to micro-tablet cartridge 146. Jig 142 may have portions142*a* that receive cartridge 146 that are made from a flexible and resilient material such that cartridge 146 can be held by friction fit by jig 142. In this way linear vibrations caused by linear vibrator 138 may be communicated to cartridge 146. Other mechanisms can be used to hold cartridge 146 on jig 142.

Cartridge 146 may have its cylindrical channel 148 aligned parallel to the longest dimension of cartridge 146 and orthogonal to base of cartridge 146. Channel 148 may be capable of receiving micro-tablets 32 and be in vibration communication with linear vibrator 148. The cross-sectional perimeter of container 148 may be of complimentary dimensions and shape to cross sectional area of micro-tablet 32. Upper aperture 150 of container 148 may be positioned at or near lower aperture 101 of feed chute 96. As referenced above, depending upon the configuration of cartridge 146, vertical, longitudinal, transverse and rotational adjustments may be made by way of plates 116, 118 and O-clamp 134 to allow for the angle and position of channel 148 in cartridge 146 to be varied while keeping upper aperture 150 of container 148 near lower aperture 101 of feed chute 96. In this way channel 148 of cartridge 146 may be set at any angle between approximately 0° and 90° degrees while upper aperture 150 of cartridge 148 is kept in close proximity to lower aperture 101.

It will also be appreciated that the use of screws and corresponding holes, along with dowel pins with corresponding apertures, as discussed above, helps ensure that the various parts are properly oriented with respect to each other. This will help ensure that when system 10 is assembled, that everything is precisely oriented to ensure that the micro-tablets move properly and reliably through the system.

Various components of system 10 such as sorting bowl apparatus 12, capture wheel apparatus 14, and cartridge holding and vibration apparatus 16 may be made of suitable materials such as by way of example only sorting bowl apparatus 12 may be made by way of example only from polished aluminium or certain ceramic materials. Also a least some of the various components of system 10 such as sorting bowl apparatus 12, capture wheel apparatus 14 and cartridge holding and vibration apparatus 16 may be integrally formed or interconnected to each other by known techniques. For example if the components are made of a suitable metal or plastic, welding techniques can be employed. Also, the use of screws and/or bolts may be employed.

The operation of system 10 will now be described in detail. First, an empty cartridge 146 that is to be filled with micro-tablets 32 will be placed in jig 142 prior to starting operation of system 10. Also, a relatively large number of micro-tablets 32 may be either by machine or manually pre-loaded into bowl 20 (not shown). Once system 10 is made operational (for example by initiating PLC 18 and controller 19 to be activated) vibration from vibrator located inside housing 34, gravity and the shape of the bottom surfaces 26*a* and 26*b* of bowl 20 can cause micro-tablets 32 to vibrate around the bowl 20 ultimately orienting themselves vertically on-edge in single file in channel 30. Micro-tablets 32 may move within channel 30 with tablets being aligned in series within channel 30. Thereafter, one at a time, tablets 32 may move out of bowl 20 via aperture 40 into loading chute 42, while maintaining their vertical on-edge orientation. When a slot 92 is not aligned with the exit aperture from chute 42, a plurality of tablets 32 will remain in series, each in a vertical, on-edge orientation.

Figure 5A:
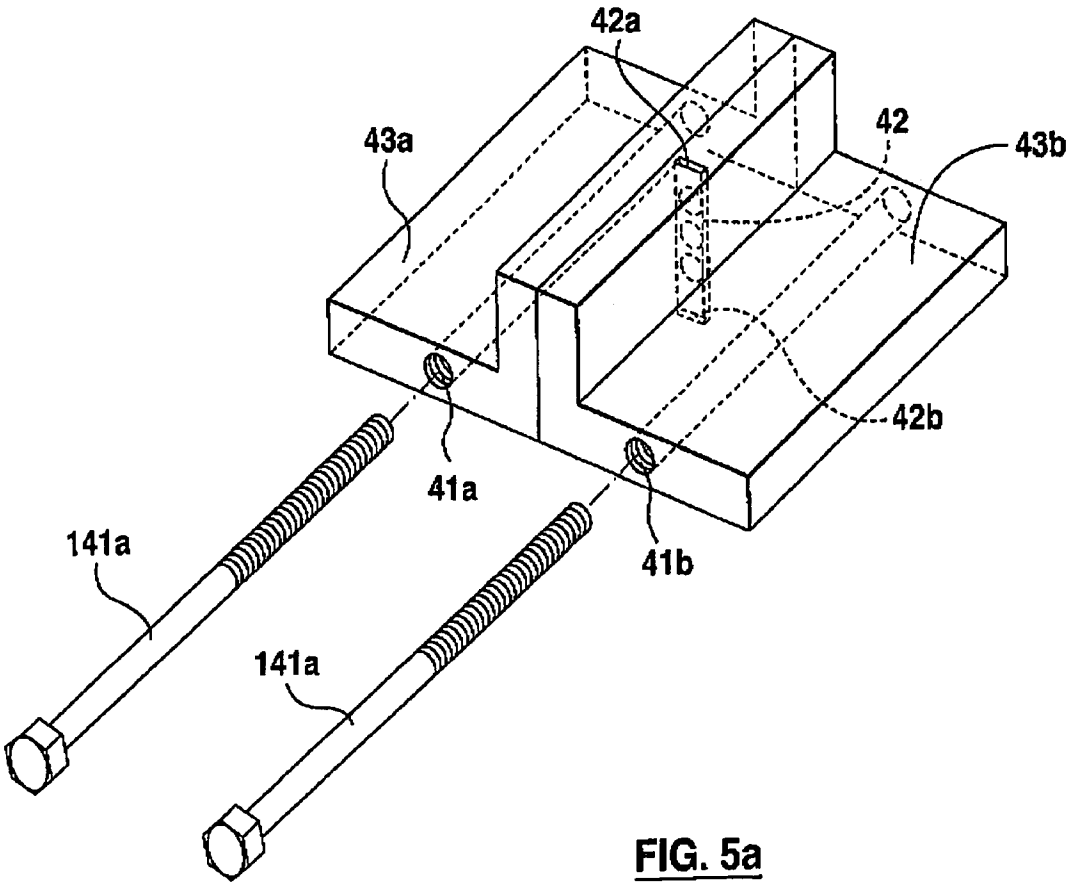
FIG. 5*a* is a perspective view of components of the system of FIG. 1.

To load a single tablet 132 into a slot 92, PLC 18 will rotate capture wheel 44 to a position such that a slot 92 is aligned with the exit aperture 42*b* from loading chute 42 (FIG. 5*a*). Then, a single tablet 132 will move from loading chute 42 into an aligned slot 92. Once a tablet is received in a slot 92, PLC 118 will cause capture wheel 44 to be rotated. PLC 18 is able to determine the required amount of movement/rotation that is required for capture wheel 44 to move to the appropriate next position and can provide the appropriate signal to motor 18 to achieve such rotation. It should be noted that the subsequent movement of capture wheel 44 may not be completed with the next slot 92 being aligned with the exit aperture form chute 42. This may, for example, be because that subsequent movement was to rotate the capture wheel 44 so that a slot 92 towards the bottom of capture wheel 44 will be moved into a tablet discharge position. However, thereafter, subsequent movement of the capture wheel 44 will eventually result in indexing such that the next slot 92 is aligned with the exit aperture 42*b* from chute 42 so that the next slot 92 can be filled.

It will be noted as shown in FIG. 4, that capture wheel 44 may be configured such that no slot 92 is presented to loading chute 42 while a slot 92 is presented to feed chute 96, and vice versa. In this way, capture wheel 44 can be rotated by motor 80 clockwise through alternate positions (a) and (b), where position (a) is a position where a tablet is fed from chute 42 from bowl 12 and position (b) is a position where a tablet is presented to and released into feed chute 96 to deliver a tablet to cartridge 146. In this way, each slot 92 in capture wheel 44 may in turn be successively filled with a tablet 32, and each slot 92 may also be successively emptied of its tablet to pass the tablet to feed chute 96.

PLC 18 may drive motor 80 to rotate capture wheel 44 in a clockwise direction and each micro-tablet 32 alternately through positions (a) and (b). In some embodiments, positions (a) and (b) may be the same (i.e. one slot 92 may be being filled from loading chute 42 while another slot 92 may be being discharged as a tablet moves into feed chute 96).

When a micro-tablet 32 is positioned in a pocket 92 that has been aligned with feed chute 96, the rotation of capture wheel 44 can eventually cause that pocket 92 to become aligned the entrance into feed chute 96 that is formed in the lower portion of shoe 74. The tablet may then pass into and through feed chute 96 in vertical on-edge orientation. During such movement through feed chute 96 it can pass micro-sensor 108 before exiting chute 96 to drop into container 148 of cartridge 146. As micro-tablet 32 drops by way of gravity through feed chute 96, micro-sensor 108 may detect passing micro-tablet 32 and register the passing of a tablet 32 with PLC 18, such that a count of tablets passed to a cartridge 146 held in holding and vibration apparatus 16 can be maintained. Detection may be facilitated by the shape of feed chute 96 which presents micro-tablet 32 to micro-sensor 108 in an on-edge orientation thereby presenting the largest surface area of micro-tablet 32 to micro-sensor 108 for detection. After a predetermined and specific number of micro-tablets 32 have been counted, PLC 18 may cause motor 80 to stop rotation of capture wheel 44. In this way, a pre-determined and specific number of micro-tablets 32 can be deposited in channel 148 of cartridge 146. At this point the filled cartridge 146 may be removed and replaced with an empty one, the counter in PLC 18 can be re-set and the capture wheel 44 re-started to begin the process of filling the next cartridge 146.

Figure 8:
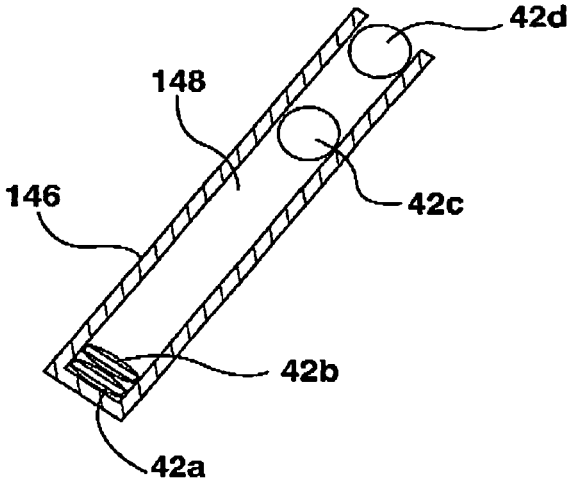
FIG. 8 is schematic side view of part of system 1 illustrating the re-orientation of tablets in a cartridge.

It should be noted that while tablets 32 are continuing to be sequentially loaded into channel 148 in a vertically on-edge orientation, linear vibration may be applied to channel 148 of cartridge 146 by vibration device 138. Due to the combined effect of: (1) the angle of channel 148 in cartridge 146; and (2) the linear vibration applied to cartridge 146 in a general Z direction, micro-tablets 32 will tend to move and be re-oriented to a position whereby they are oriented in a stacked flat orientation within channel 148. For example, with reference to FIG. 8, tablets 42*a*, 42*b* are shown in their stacked relationship to each other within channel 148. Tablet 42*c* may proceed down the channel 148 until it contacts with the upward face of tablet 42*b*. At that point the effect of the vibration device will be such as to cause tablet 42*e* to re-orient itself into a stacked relationship with tablets 42*a* and 42*b*. Tablet 42*d* will subsequently follow a similar path. It will be appreciated that the linear vibration should be selected to be of a frequency and amplitude that it does not cause tablets 42, once re-oriented into a stacked relationship to become upset from that orientation.

In some embodiments filling certain types of tablets, it may not be necessary for channel 148 to be oriented at an angle from the vertical. Stacking of the tablets (into what would according therefore be a stacked horizontal arrangement) may in such embodiments be achieved solely by the linear vibration. In each situation a person skilled in the art will be able select the parameters of the frequency and magnitude of the linear vibration, and the angle at which the channel 148 of the cartridge is held in order to achieve loading of tablets that form a stacked orientation.

After a pre-determined number of micro-tablets 32 have been counted, PLC may send an electronic signal to motor 80 causing motor 80 to stop rotation of capture wheel. In this way, a pre-determined and specific number of micro-tablets 32 can be deposited in channel 148 of cartridge 146. At this point the filled cartridge 146 may be removed and replaced with an empty one. PLC 18 can be re-set and system 10 restarted such that capture wheel 44 recommences the process of filling the next cartridge 146.

By way of example only, a channel 148 in a cartridge that holds 40 micro-tablets may be filled in about 30 seconds using a system 10.

Many variations of the embodiments described above are possible. By way of example only, the system could, with some modifications, function with containers 148 oriented at angles other that 30° and with vibration other than linear vibration.

The systems may also consist of other components that deliver tablets in series to a cartridge holding and vibration apparatus like apparatus 16.

Also, it will be appreciated that the system may be modified to accommodate other types of tablets, capsules, pills or similar products.

Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

When introducing elements of the present invention or the embodiments thereof, the articles "a," "an," "the," and "said" are intended to mean that there are one or more of the elements. The terms "comprising," "including," and "having" are intended to be inclusive and mean that there may be additional elements other than the listed elements.

The invention claimed is:

1. A system for stacking a plurality of tablets within a container comprising:

(a) a container comprising a generally elongated channel having a first end and a second end, said first end being positioned above said second end and having an aperture for receiving a plurality of tablets in series into said channel, said second end providing at least partial support for a plurality of tablets stacked within said channel;

(b) a container holding apparatus for releasably holding said container;

(c) a vibration device operable to apply linear vibration to said container while said container is being held by said holding apparatus; and (d) a tablet delivery system operable to deliver said plurality of tablets sequentially to said first end of said channel;

wherein said linear vibration of said container provided by said vibration device is operable to align said sequentially loaded plurality of tablets received into said channel in a stacked formation within said channel.

2. A system as claimed in claim 1 wherein said channel in said container is oriented at an angle from the vertical so as to create a downward slope from said first end towards said second end of said channel.

3. A system as claimed in claim 2 wherein said channel has a cross section shape and size that is generally complimentary to the cross-sectional size and shape of said plurality of tablets such that said tablets can be stacked within said channel.

4. A system as claimed in claim 1 wherein said channel has a longitudinal axis and said linear vibration is in a direction aligned with said longitudinal axis of said channel.

5. A system as claimed in claim 1 wherein said vibration of said container is solely substantially linear.

6. A system as claimed in claims 5 wherein said vibration is at a frequency of in the range of about 3000 to 3600 oscillations per minute.

7. A system as claimed in claim 1 wherein said linear vibration of said container is continuous during loading of said plurality of tablets into said container.

8. A system as claimed in claims 7 wherein said angle is about 30 degrees from vertical.

9. A system as claimed in claim 1 wherein said container is a cartridge adapted for use with a tablet dispensing device.

10. A system as claimed in claim 1 wherein tablet delivery system comprises a capture wheel apparatus having a capture Wheel that is operable to receive said plurality of tablets in series at an input station and rotate said tablets to an output station for discharge to said channel of said container.

11. A system as claimed in claim 10 operable such that said tablets may be delivered in series in an on-edge orientation to said capture wheel apparatus and rotated by said capture wheel while in said on-edge orientation.

12. A system as claimed in claim 11 further comprising a tablet detection and counting apparatus for detecting and counting the number of said plurality of tablets discharged by said capture wheel apparatus to channel of said container.

13. A system as claimed in claim 11 further comprising a sorting bowl apparatus operable to deliver said plurality of tablets in series in said on-edge orientation to said input station of said capture wheel apparatus.

14. A system as claimed in claim 1 wherein the rotation of said capture wheel is operable to be controlled by a controller that is operable to be in communication with said capture wheel apparatus.

15. A system as claimed in claim 1 operable such that said tablets may be delivered in series in an on-edge orientation to said aperture at said first send of said channel.

16. A system for packaging a plurality of tablets comprising:

(a) a container comprising a generally elongated channel having a first end and a second end positioned below said first end, said first end having an aperture for receiving a plurality of tablets in series into said channel;

(b) a container holding and vibration apparatus operable to hold said container and concurrently apply linear vibration in a direction to said container; and (c) a tablet delivery system operable to deliver said plurality of tablets in series to said first end of said container in a direction that is substantially in alignment with the direction of linear vibration of said container;

wherein said linear vibration of said container provided by said vibration device is operable to align said sequentially loaded plurality of tablets in a stacked formation within said channel of said container.

17. A system as claimed in claim 16 operable such that said tablets may be delivered in series in an on-edge orientation to said aperture at said first send of said channel.

18. A system as claimed in claim 16 wherein said channel in said container is oriented at an angle from the vertical so as to create a downward slope from said first end towards said second end of said channel.

19. A system as claimed in claim 16 wherein said channel has a longitudinal axis and said linear vibration is in a direction aligned with said longitudinal axis of said channel.

20. A system as claimed in claim 16 wherein said tablet delivery system comprises:

(i) a sorting bowl apparatus;

(ii) a motor having a drive shaft;

(iii) a capture wheel apparatus having a rotating capture wheel with a plurality of slots, each operable for holding a tablet, said capture wheel being mounted to said drive shaft of said motor;

(iv) a controller operable for controlling the rotation of said drive shaft of said motor;

wherein said sorting bowl apparatus is operable to arrange a plurality of said tablets in series and deliver said tablets in series to said capture wheel apparatus, and wherein said capture wheel apparatus is operable to receive tablets from said sorting bowl apparatus and deliver said tablets in series to be received at said aperture at said first end of said channel to be received within said channel in said container.

21. A system as claimed in claim 20 further comprising a sorting bowl apparatus operable to deliver a plurality of tablets in series to said capture wheel of said capture wheel apparatus.

22. A system for packaging a plurality of tablets comprising:

(a) a container comprising a generally elongated channel having a first end and a second end, said first end having an aperture for receiving a plurality of tablets in series into said channel;

(b) a container holding and vibration apparatus operable to hold said container and concurrently apply linear vibration in a direction to said container; and (c) a tablet delivery system operable to deliver said plurality of tablets in series in an on-edge orientation to said first end of said container in a direction that is substantially in alignment with the direction of linear vibration of said container;

(d) a tablet detection and counting system for detecting each of said plurality of tablets being delivered by said tablet delivery system while each of said plurality of tablets is in said on-edge orientation;

wherein said linear vibration of said container provided by said vibration device is operable to align said sequentially loaded plurality of tablets in a stacked formation within said channel of said container.

23. A method of loading a container having an elongated channel with tablets, said method comprising:

(a) loading said channel with a plurality of tablets;

(b) applying linear vibration to said channel containing said tablets;

wherein said linear vibration of said channel is operable to align said plurality of tablets in a stacked formation within said channel.

24. A method as claimed in claim 23 further comprising orienting said channel during said vibration at an angle offset from a vertical orientation.

25. A method as claimed in claim 23 further comprising loading said plurality of tablets singly in series to said channel of said container.

26. A method as claimed in claim 25 comprising continuously applying said linear vibration of said channel during said loading of said plurality of tablets into said channel of said container.

27. A method as claimed in claim 23 wherein channel is loaded with said plurality of tablets that are delivered in series in an on-edge orientation.

28. A system of loading a container having an elongated channel with tablets, said system comprising:

(a) a means for loading said channel with a plurality of tablets;

(b) a means for applying linear vibration to said channel containing said tablets;

wherein said linear vibration of said channel is operable to align said plurality of tablets in a stacked formation within said channel.

* * * * *

UNITED STATES PATENT AND TRADEMARK OFFICE

CERTIFICATE OF CORRECTION

PATENT NO. : 8,499,534 B2
APPLICATION NO. : 12/821438
DATED : August 6, 2013
INVENTOR(S) : Brian Ernest Gosse, Kenneth James Woolley and Martin Vincent Waite It is certified that error appears in the above-identified patent and that said Letters Patent is hereby corrected as shown below:

In the Claims:

Column 14
Claim 6, line 37, replace “claims” with --claim--
Claim 8, line 43, replace “claims” with --claim--

Column 15
Claim 15, line 3, replace “send” with --end--
Claim 17, line 23, replace “send” with --end--

Signed and Sealed this
Twenty-sixth Day of November, 2013

Margaret A. Focarino

Margaret A. Focarino
*Commissioner for Patents of the United States Patent and Trademark Office*